United States Patent [19]

Seto

[11] 3,977,673

[45] Aug. 31, 1976

[54] SHEET CONVEYOR MECHANISM

[75] Inventor: Yutaka Seto, Hachioji, Japan

[73] Assignee: Konishiroku Photo Industry Co., Ltd., Japan

[22] Filed: Sept. 25, 1975

[21] Appl. No.: 617,299

[30] Foreign Application Priority Data

Oct. 1, 1974 Japan ..... 49-113632

[52] U.S. Cl. ..... 271/277; 271/204

[51] Int. Cl.² ..... B65H 5/02

[58] Field of Search ..... 271/277, 204, 205, 206, 271/82; 198/180; 226/173

[56] References Cited

UNITED STATES PATENTS

| | | | |
|---|---|---|---|
| 1,999,587 | 4/1935 | Davis | 271/205 X |
| 3,447,800 | 6/1969 | Reinhardt | 271/277 |
| 3,918,707 | 11/1975 | Villemer | 271/277 |

*Primary Examiner*—Richard A. Schacher

*Attorney, Agent, or Firm*—Bierman & Bierman

[57] ABSTRACT

A sheet conveying device comprising a support frame and a pinch roll, the pinch roll having a length approximately equal to the width of the sheet. The pinch roll is rotatable to advance the sheet between the pinch roll and support frame. The pinch roll rotation can be reversed to discharge the sheet.

2 Claims, 4 Drawing Figures

SHEET CONVEYOR MECHANISM

This invention relates to a sheet conveyor mechanism for conveying printing paper, copying paper or the like.

In general, use has been made of a method of conveying a sheet along a given conveying path while gripping the sheet at its end with a gripper or the like so as to provide secure conveying in a printing machine and a copying machine. Such a conveying method is disclosed in Japanese Pat. No. 25955/65, in which a supporting frame provided with a gripper is mounted on a conveying band such as a movable chain and the gripper has an uneven portion and gripping function is provided by pinching a sheet between a plurality of pawls adapted to be opened and the receiving surface formed on the support frame and by releasing the sheet by moving the pawls from the gripping position by means of a fixed cam located near the conveying path. This method is satisfactory for a printing machine and a copying machine of relatively small type or the like in that a receiving board serving as a support does not deform even when it is not made so thick and no large resistance is applied to the sheet when it is carried as the area of the sheet is so small, so that sufficient pinching force can be held with the properly spaced pawls. This method has notwithstanding drawbacks in that the tip of the pawls for gripping may eat into the surface of the sheet and cause any damage to the tip of the sheet, and a large tension may be exerted only on that portion of the sheet which is gripped by the pawls and cause deformation of the sheet.

It is also disadvantage of such method that application of the gripping device as above-mentioned to a copying machine of a large type may cause deformation of a support frame serving as a receiving board of the grip so that normal gripping operation is not provided, and that, with the width of the support frame being made large, the conveying device is injured in its conveying ability and the support frame will increase in weight with the result that adverse effects will be given to conveying velocity.

This invention has been proposed to overcome these drawbacks and has such arrangement that a support frame is mounted on a conveying device moving in a given direction and a pinch roll having substantially the same length as the width of a sheet is rotatably arranged on the support frame and the sheet is carried while being pinched between the flat surface of the support frame and the pinch roll. When it is desired that the sheet be pinched, the pinch roll is rotated so as to allow the tip of the sheet to advance into between the pinch roll and the support frame and to be pinched therebetween and the pinch roll is kept unrotated during carrying of the sheet. When it is desired that the sheet be released, the pinch roll is rotated in the reverse direction and discharges the sheet outwards. In this manner, the holding of the sheet is ensured by enabling the tip of the sheet to be pinched between the pinch roll and the entire surface of the support frame and combination of the pinch roll and the support frame avoids deformation of the support frame itself.

The invention will now be described in more detail with reference to the embodiment shown in the accompanying drawings in which.

Figure 1:
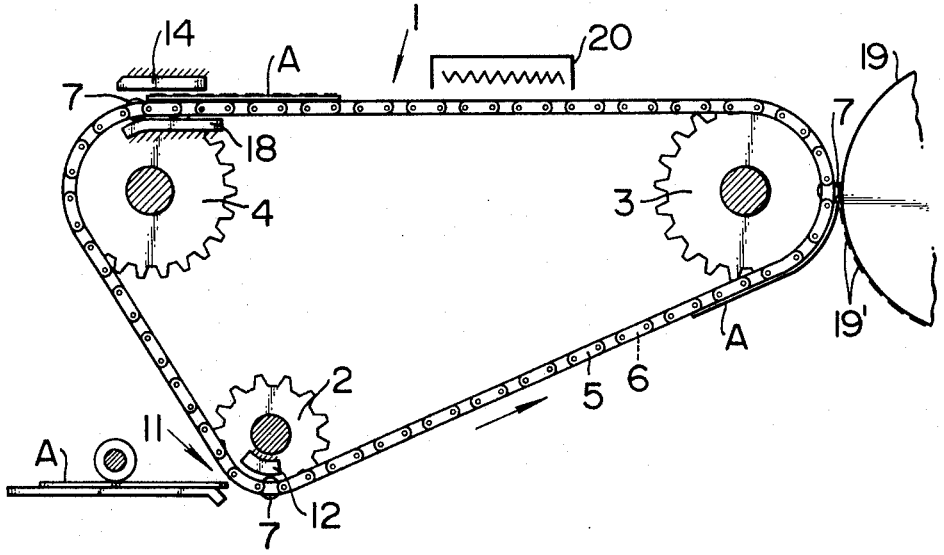
FIG. 1 is a front view of the whole of a sheet conveying mechanism.
Figure 2:
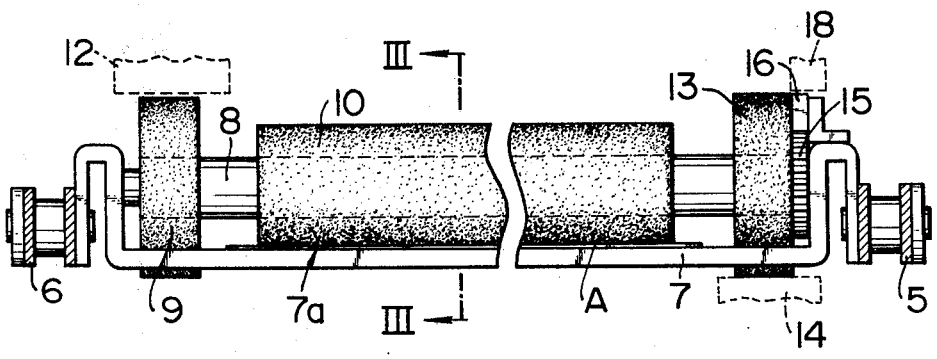
FIG. 2 is a side view of the gripper device.

Referring now to FIG. 1, a conveying device 1 comprises three sprockets 2, 3 and 4, chains 5 and 6 each stretching among the sprockets and support frames 7 mounted with a certain distance apart from each other at the normal position with respect to the advance direction of the chains 5 and 6 with its respective ends secured thereto. As shown in FIG. 2, the support frame 7 has a rotatable longitudinal shaft 8 and a pinch roll 10 having substantially the same length as the width of a copying paper and made of synthetic resin or rubber which roll is located at the intermediate position of the shaft 8 in contact with the flat portion 7*a* formed on the support frame 7. A rotating roll 9 which rotates the pinch roll 10 when pinching the copying paper and is made of a frictional material such as rubber is secured to one end of the shaft 8. The roll 9 is arranged in such a way as to make contact with a cam plate 12 fixed at the lateral side of a supply position 11 for copying paper A near the conveying device 1. A drive roll 13 which rotates the pinch roll 10 to release the copying paper A and is made of the same frictional material as the frictionally rotating roll 10 is secured to the shaft 8. The roll 10 is arranged in such a way as to make contact with a cam plate 14 fixed near the conveying device 1 at the position where the copying paper A is released. A ratchet wheel 15 is secured to the outer side of the drive roll 13 and catches in a ratchet pawl 16 mounted on the support frame 7. The ratchet pawl 16 has a spring 17 elastically biased thereon and is adapted to catch in the ratchet wheel 15 all the time. Arrangement is such that the ratchet pawl 16 is caused to rotate at the time of loading of the copying paper A and the drive roll 13 is caused to rotate only when the catch of the ratchet pawl 16 is released at the time of release of the copying paper. Reference numeral 18 is a fixing cam for opening the ratchet pawl 16 and reference numeral 19 designates a photosensitive material and reference numeral 20 is a fixing device.

Three support frames 7 shown in FIG. 1 have respectively gripper, that is, the shaft 8, the pinch roll 10, roll 9, roll 13, etc., as shown in FIG. 2.

Figure 3:
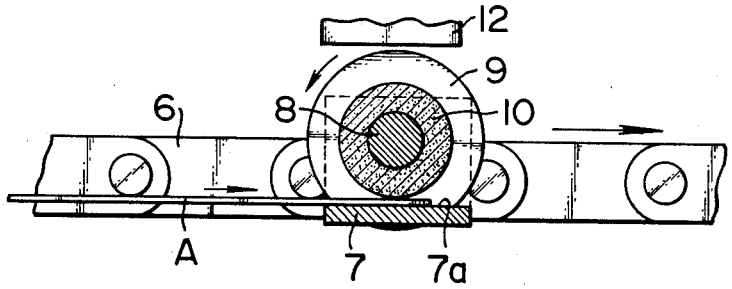
FIG. 3 is a sectional view of the gripper device taken along the line III — III of FIG. 2
Figure 4:
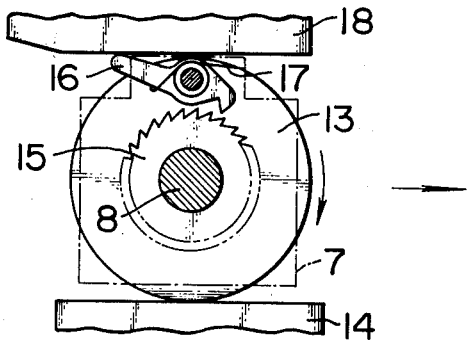
FIG. 4 is a front view of the ratchet of the gripper device.

The conveying device will now operate as follows:

In FIG. 1, a copying paper A is supplied in the conveying device 1 at a feed position 11. At this stage, the support frame 7 takes a position just ahead of the feed position 11 and the frictionally rotating roll 9 is rotated counterclockwise (in FIG. 3) by the cam plate 12 as shown in FIG. 3. The copying paper A is put into between the pinch roll 10 and the flat portion 7*a* of the support frame 7 and firmly pinched therebetween in accordance with the length of contact of the rotating roll 9 with the cam plate 12. As the ratchet wheel 15 is ratcheted from its clockwise rotation by the pawl 16, the copying paper is securely gripped between the support frame 7 and the pinch roll 10.

Referring again to FIG. 1, the chains 5 and 6 are moved in the direction of an arrow as the sprockets 2, 3 and 4 rotate, so that a toner image 19' formed on a photosensitive material 19 is transferred onto the copying paper A. Though there may be a resistive force applied on the outer surface of the copying paper A at the time of, for instance, transfer of the image which force will put the paper A out of the pinch portion between the pinch roll 10 and the support frame 7, the pinch roll 10 is kept unrotated by catching of the ratchet pawl 16 in the ratchet wheel 15 of the drive roll 13 with the aid of the spring 17 and thus the copying paper A does not come off. Then the copying paper A after fixed by the fixing device 20 is discharged outside. Just before the paper A is discharged, the ratchet pawl 16 is turned as a result of contact thereof with the cam plate 18 against elasticity of the spring 17 and the ratchet wheel 15 is released. At the same time, the drive roll 13 is brought into contact with the cam plate 14 secured at the opposite side and is caused to rotate clockwise. Conveying of the copying paper A follows such order of operation as above described.

As seen from the foregoing, the conveying device according to the invention is such that a rotatable pinch roll 10 is mounted on a support frame 7 and the pinch roll 10 is rotated in such a direction as to enable pinching of a sheet material when the sheet material is to be pinched and then the pinch roll 10 is kept unrotated during conveying of the sheet material in order to prevent it from coming off, and, when the sheet material is to be discharged, the locking means for the pinch roll 10 is released and the pinch roll 10 is caused to rotate in the discharging direction. Provision of a plurality of pinch rolls on the support flame 7 enable very smooth pinching and discharging of the sheet material. Moreover, complete prevention of coming off of the sheet material can be achieved by firm gripping thereof and no damage is given and no crease is made in the sheet material when it is pinched.

In the embodiment as shown in the drawings and as described above, there has been illustrated combination of a support frame and a rotatable roll, however, the support frame may be replaced by another rotatable roll which is associated with the roll to pinch a sheet material therebetween.

What we claim is:

1. A sheet conveying mechanism comprising a. a pair of moving conveying members, b. driving means for said conveying member, c. at least one frame mounted on said conveying members, the frame having a flat surface on which a sheet is located, d. at least one pinch roll mounted on said frame so as to substantially contact with said flat surface, e. a first cam positioned at a position near the path of movement of said frame, f. a second cam positioned at another position near said path, and g. means for rotating said pinch roll by actuation of said first and second cams to grip and release the sheet.

2. A sheet conveying mechanism according to claim 1 further comprising a ratchet means for preventing said pinch roll from its rotation in one direction, said ratchet means being actuated by said second cam to release said pinch roll.

* * * * *